US007150647B2

(12) United States Patent
Chen

(10) Patent No.: US 7,150,647 B2
(45) Date of Patent: Dec. 19, 2006

(54) IN-LINE SOCKET DEVICE AND ITS FABRICATING METHOD

(75) Inventor: Wen Tang Chen, Hsinchu (TW)

(73) Assignee: Willis Electric Co., Ltd. (TW)

( * ) Notice: Subject to any disclaimer, the term of this patent is extended or adjusted under 35 U.S.C. 154(b) by 4 days.

(21) Appl. No.: 10/771,106

(22) Filed: Feb. 3, 2004

(65) Prior Publication Data

US 2005/0170688 A1 Aug. 4, 2005

(51) Int. Cl.
*H01R 11/00* (2006.01)

(52) U.S. Cl. ..... 439/502

(58) Field of Classification Search ..... 439/502, 439/106, 658, 606, 599, 696, 695, 806, 148, 439/659

See application file for complete search history.

(56) References Cited

U.S. PATENT DOCUMENTS 2,517,593 A * 8/1950 O'Brien et al. ..... 439/658
2,567,961 A * 9/1951 O'Brien et al. ..... 200/51.15
2,659,873 A * 11/1953 Cataldo ..... 439/466
2,710,949 A * 6/1955 Happe et al. ..... 439/806
3,167,375 A * 1/1965 Sarazen ..... 439/404
3,482,263 A * 12/1969 Ryder ..... 439/604
3,582,868 A * 6/1971 Trimble et al. ..... 439/523
3,723,948 A * 3/1973 Wyatt et al. ..... 439/107
4,245,880 A * 1/1981 Zimmerman et al. ..... 439/405
4,408,813 A * 10/1983 Koehler ..... 439/148
6,527,598 B1 * 3/2003 Opel ..... 439/709
6,802,741 B1 * 10/2004 Shatkin ..... 439/620
6,837,598 B1 * 1/2005 Marcus ..... 362/374
6,945,796 B1 * 9/2005 Bassler et al. ..... 439/101

* cited by examiner

*Primary Examiner*—Tulsidas C. Patel
*Assistant Examiner*—Phuongchi Nguyen
(74) *Attorney, Agent, or Firm*—McGlew & Tuttle, PC

(57) ABSTRACT

Disclosed is an in-line socket device and its fabricating method. The in-line socket device is covered with a cover shell, and has a movable safety cover connected with one end of the cover shell. The socket device is composed of a base and a base cover, in which one end of the base is open and the other end has three plug sockets. A plurality of axial slots are formed inside the opened end for covering up wires, and terminals are provided within axial slots to make the crimping end and the bared wire to be clipped; accordingly, partial sections of the wires connected with the terminal crimping end can crimp the bared wire through peeling off the PVC cover layer of the section, so that the integrity of wires can be ensured and the problem of power consumption or fallen off from the connection can be prevented.

33 Claims, 11 Drawing Sheets

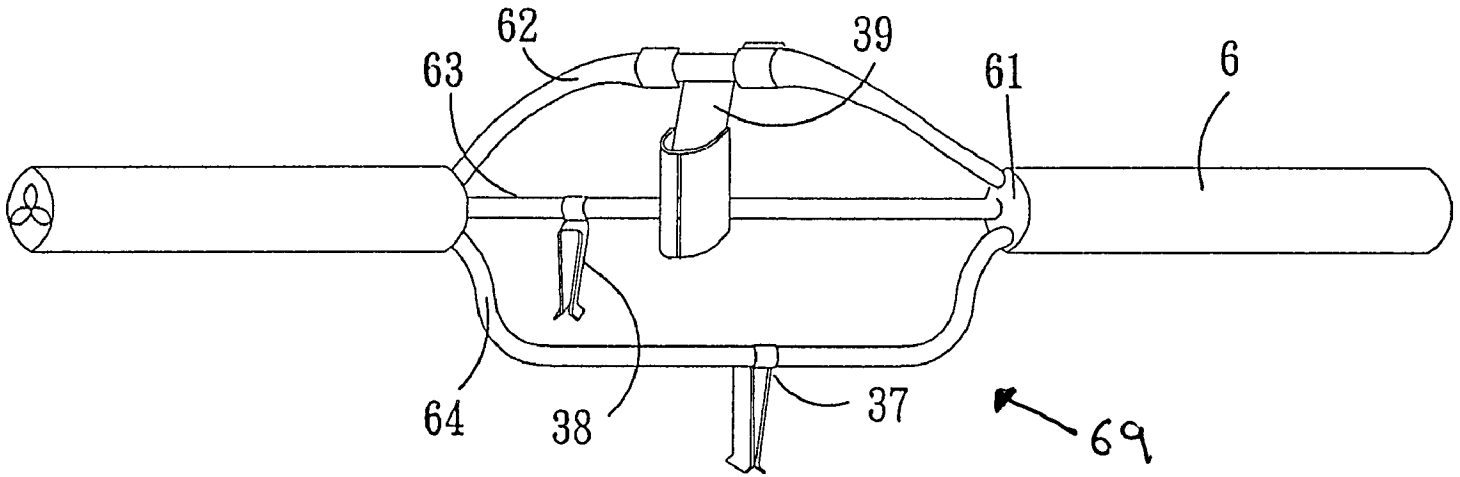
FIG. 3A
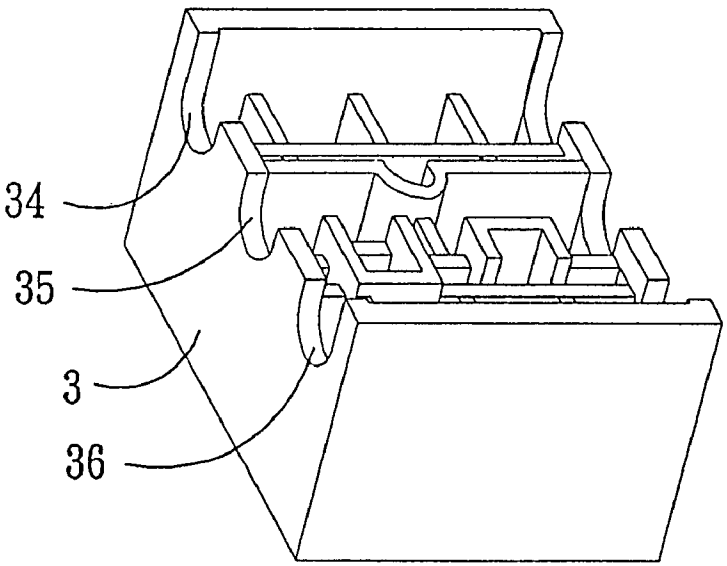

IN-LINE SOCKET DEVICE AND ITS FABRICATING METHOD

FIELD OF THE INVENTION

The present invention relates to an in-line socket device and its fabricating method, and more particularly to an in-line socket device and its fabricating method, which can maintain the integrity of the internal wire in the socket without the problem of connection and falling off, and includes a safety cover to prevent from the danger of plugging in incorrectly and getting an electric shock.

BACKGROUND OF THE INVENTION

Accordingly, the use of sockets is essential to home use or a place where electric appliances are used. As shown in the figures, a positive conductor terminal 11, a negative conductor terminal 12, and a grounding conductor terminal 13 are set up in the internal partition of the socket 1, and the central section of each conductor terminal forms axial extension portion to plug in the plug socket of the socket. The two ends of the socket are connected to the wires 141, 142, 143, 151, 152, and 153 of the first wire 14 and second wire 15, wherein after the current flows through the first wire 14 to the second wire 15, a positive conductor terminal 11 and negative conductor terminal 12 in the socket can be simultaneously conducted by electric current, so that a plug is plugged to conduct electricity.

The structure of the socket described above has deficiencies as stated below:

1. The internal part of the plug mainly uses the copper material of the terminal as the medium of the first wire and the second wire. Since the material cost of copper terminal is high, the cost of the socket is increased.

2. The power transmission of the first wire and the second wire needs to be completed by the terminal, which relatively results in incompletion and incoherency of power transmission. Whether the terminals are connected to the wires through entwined or welding procedures, it is more likely to cause power loss wastage due to the difference of the connecting part or the terminal material and the wire quality.

3. As the first wire and the second wire are connected to the terminals point to point, this also makes the wires easily fall apart as a result of the impact of external force, which causes breaking circuits and electric shock, and even increases the possible instability and danger for personnel and productivity of a factory when used in a high-voltage power supply place.

4. Under the general condition, the socket appears to be totally bared. Consequently, it is possible for a child to incorrectly plug a small piece of metal into the socket and brings about the danger of electric shock.

Accordingly, the present invention has been invented for many years to solve the above-mentioned problems occurred in the prior art.

SUMMARY OF THE INVENTION

Accordingly, an object of the present invention is to provide an in-line socket device, which completely changes the conventional way of cutting off the power in order for the connection, that is, directly peeling off the outer wire layer of the wire so that the wire can provide power transmission without lose of integrity. This not only solves the problem of unstable power transmission, but also avoids the time and cost of welding or reprocessing after being entwined.

According to the in socket device of the present invention, the current is transmitted through the wire. Therefore, the terminal materials can be largely reduced, and the material cost can be relatively reduced, so that the purpose of facilitating the assembly can be achieved.

According to the in-line socket device of the present invention, a cover shell is set in the external part of the socket, which covers the combined socket device. One end of the cover shell is a transparent part, which exposes the plug socket of the socket for plug in. In addition, a safety cover is provided, which is connected to the cover shell through the other end and its size is approximately equal to the transparent part of the cover shell, so that the plug socket of the socket can be completely covered to ensure safe use.

According to the in-line socket of the present invention, the base of the socket can be made from transparent materials. Then, neon lamps can be used in the socket to timely show the status of electric conduction for the users' convenience.

The present invention further provides a method of fabricating the in-line socket device, wherein the wires are connected to the socket. The socket, comprising a base and a base cover, is formed through injection molding. One end of the molded base is opened and the other end has three plug sockets, wherein three through axial slots, with adaptive spaces that can cradle conductor terminals, and scarf holes are formed. The positive terminal, negative terminal, and ground terminal are formed through punching, and the crimping end of the terminals are upwardly raised arc-shaped conductor slices, wherein, its body is extended downward to form a terminial clip-head or clip tube, next, covering the wires that have been peeled off the outer layer PVC and internal layer PVC to the axial slot of the base, connecting the bared wires to the positive terminal, negative terminal, and ground terminal, and then combine the base cover.

After that, forming the cover shell through injection molding in the external part of the socket, and the safety cover connected to one end of the cover shell, and forming a tenon in the combination end of a safety cover in order to promptly cover the plug socket of the socket for safe covering.

The detailed structure, application rationale, features and advantages of the present invention will be more apparent from the following detailed description taken in conjunction with the accompanying drawings:

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

FIG. 3A is a partial three-dimensional disassembled view of the present invention.

DESCRIPTION OF THE PREFERRED EMBODIMENT

Figure 1:
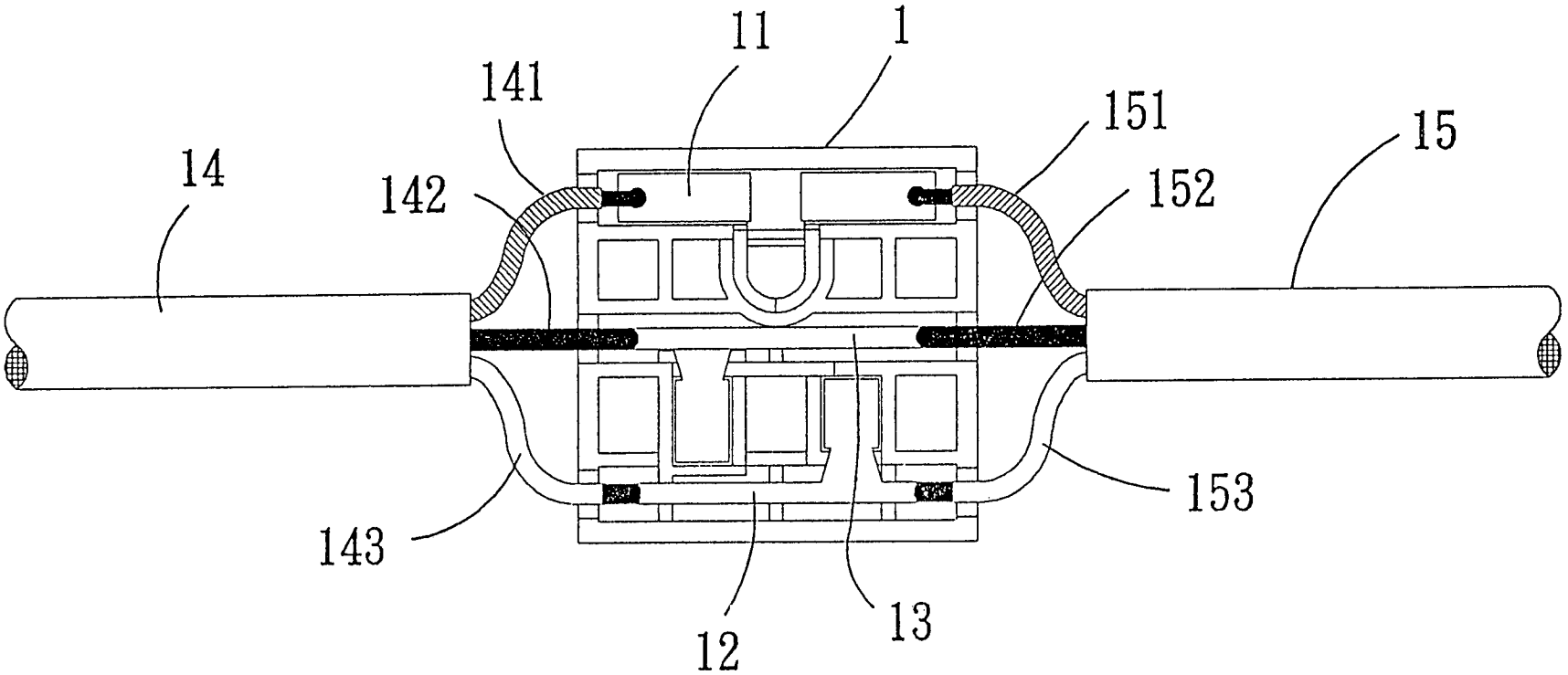
FIG. 1 PRIOR ART
FIG. 1 is a three-dimensional view of the conventional socket.
Figure 2:
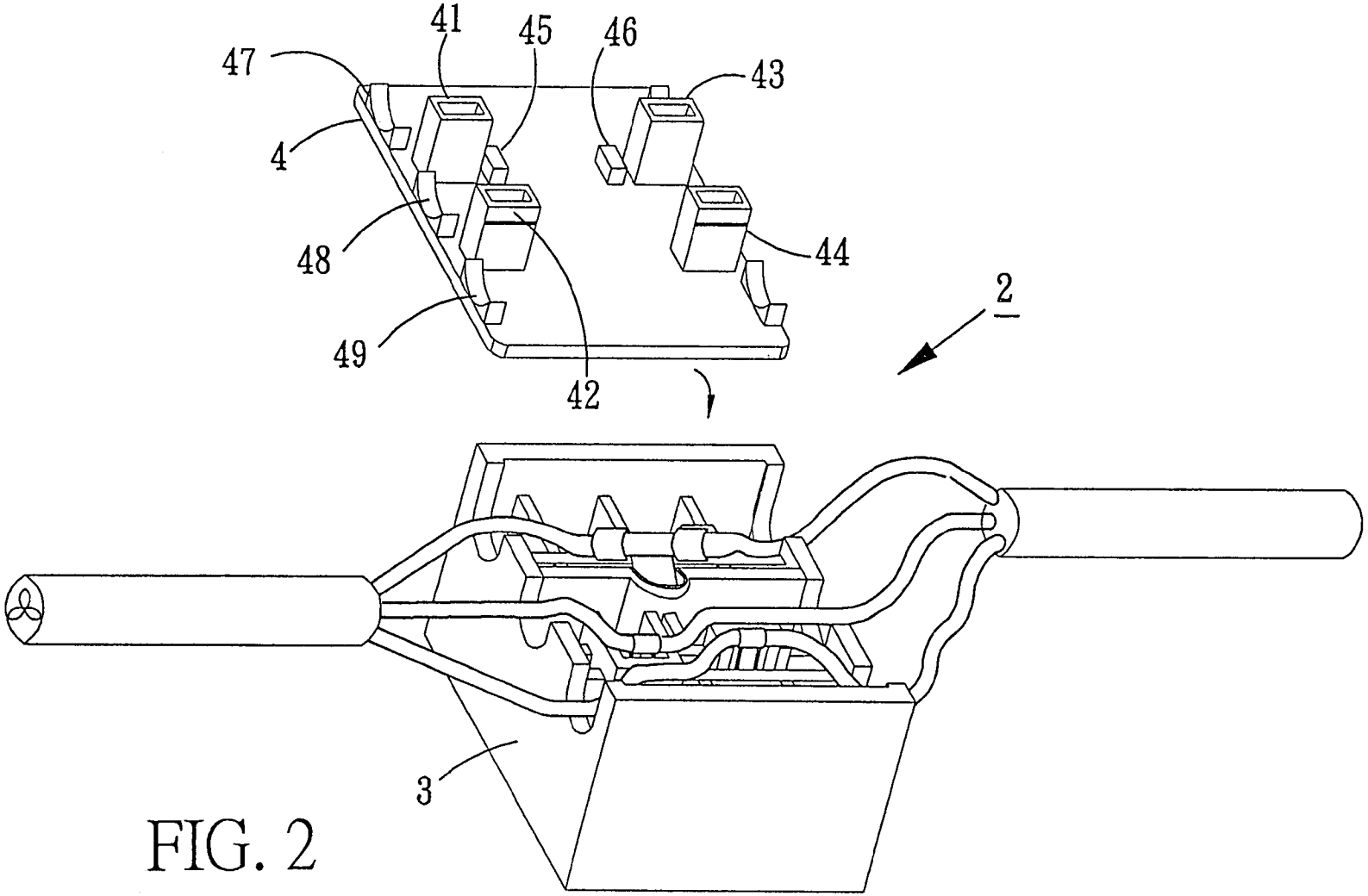
FIG. 2 is a three-dimensional disassembled view of the present invention.
Figure 3C:
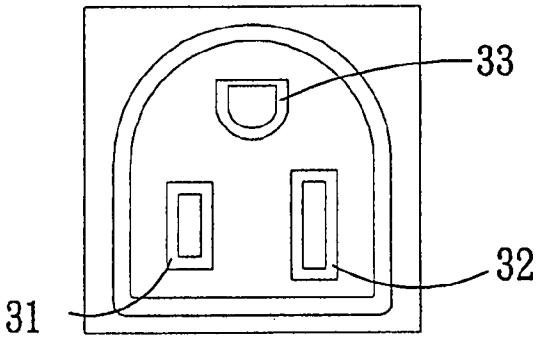
FIG. 3C is a bottom view of a base according to the present invention.
Figure 3D:
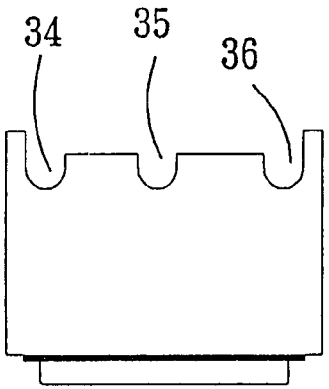
FIG. 3D is a side view of a base according to the present invention.

In the in-line socket device of the present invention, as shown in FIGS. 2, 3A, 3B, 3C, 3D, and 4, the in-line socket device 2 is composed of a base 3 and a base cover 4. One end of the base 3 is opened and the other end forms three plug sockets 31, 32, and 33 as shown in FIG. 3C. The upper opened end forms three through and mutually parallel axial slots 34, 35, and 36, where the axial slot 34, 35, and 36 are partial arc-shaped slots. The other partial arc-shaped slots 47, 48, and 49 are formed on one side corresponding to the base cover 4. After its combination with the base cover 4, a circle slot that can cover the passed internal wire is formed.

Figure 3B:
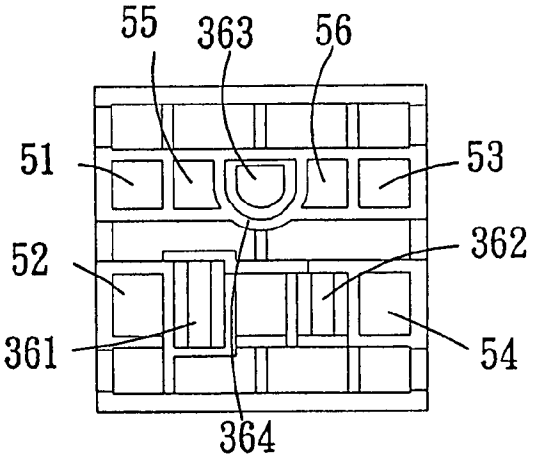
FIG. 3B is a top view of a base according to the present invention.

According to FIG. 3B, the internal part of base 3 is separated from a positive terminal adaptive space 361, a negative terminal adaptive space 362, and a grounding terminal adaptive space 363 by a plurality of partitions, and forms a plurality of scarf holes 51, 52, 53, 54, 55, and 56. The internal side of the grounding terminal adaptive space 363 is encircled by an arched edge 364 for the plug-in of the plug grounding end; the scarf hole 51, 52, 53, and 54 are located on its left and right side, which mainly serves to provide the compact-shaped combination of the base cover 4 and base 3. The scarf hole 55 and 56 are located on the two sides of the grounding terminal, and are used for fortifying the grounding terminals fixed through the crimping of the plug socket 45 and 46 formed on the base cover 4 after combining the base cover 4 and the base 3.

Figure 4:
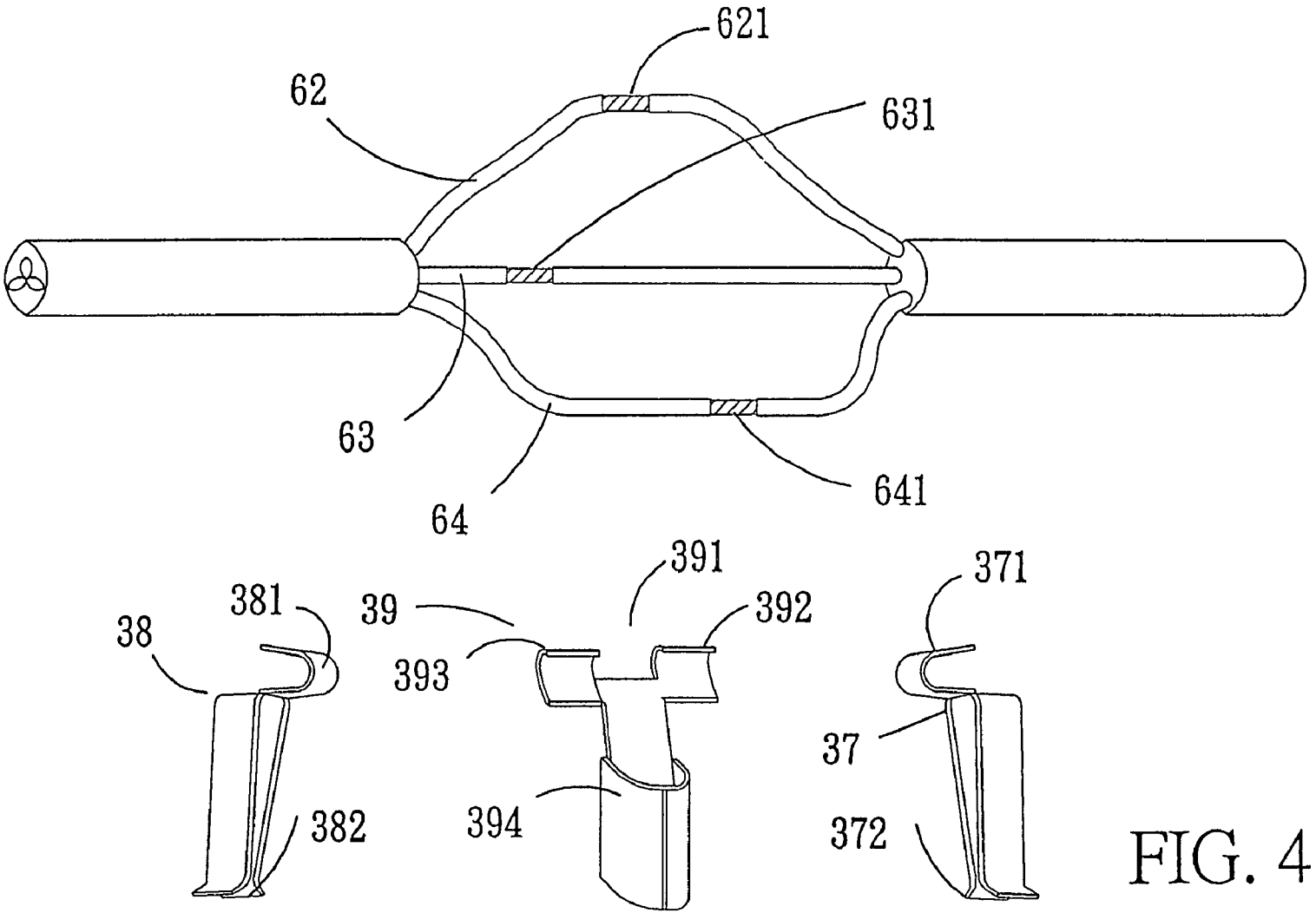
FIG. 4 is a partial three-dimensional disassembled view of the present invention.

According to FIG. 3A and FIG. 4, there is also provided a positive terminal 37, a negative terminal 38, and a grounding terminal 39, wherein the positive terminal 37 and the negative terminal 38 have a crimping end 371 and 381 respectively, which are raised upward and arc shaped, and its body is formed of 2 slides, each of the slides extending downward to jointly form terminal clip head for clipping a plug conducting pillar.

The crimping end 391 in the upper edge of the grounding terminal 39 is upwardly raised double bended arc-shaped slices 392 and 393 within a proper distance, and its body is a clip tube 394 with arched edge, which can be used for clipping a plug grounding pillar as can be seen in FIG. 4.

According to FIG. 2, a plurality of plug tenons 41, 42, 43, 44, 45, and 46 is formed on the one side of base cover 4, where the plug tenons 41, 42, 43, and 44 are located in the left and right side respectively as rectangle frames, which can be plugged into the scarf hole 51, 52, 53, and 54 of the base. Moreover, there is provided a plug tenons 45 and 46 within a proper distance near one side, corresponding to the scarf hole 55 and 56 of the base, so that the two sides and upper edge of a grounding terminal 39 can be crimped to be fixed. Also, the separated partial arc raised pillars 47, 48, and 49 are provided in the corresponding position of its base side and the axial slot of base 34, 35, and 36, which can actualize the clipping upward and downward of internal wires along with the base axial slot 34, 35, and 36 after its combination with the base 3 to ensure the stability of internal wires.

Through the compact combination of the plug tenons 41, 42, 43, 44, 45, and 46 and scarf hole 51, 52, 53, 54, 55, and 56 of the base by a base cover 4, and through the adjustment of the location and size of the plug tenons 41, 42, 43, 44, 45, and 46 the combination direction of the base cover 4 and base 3 can be controlled.

Figure 5A:
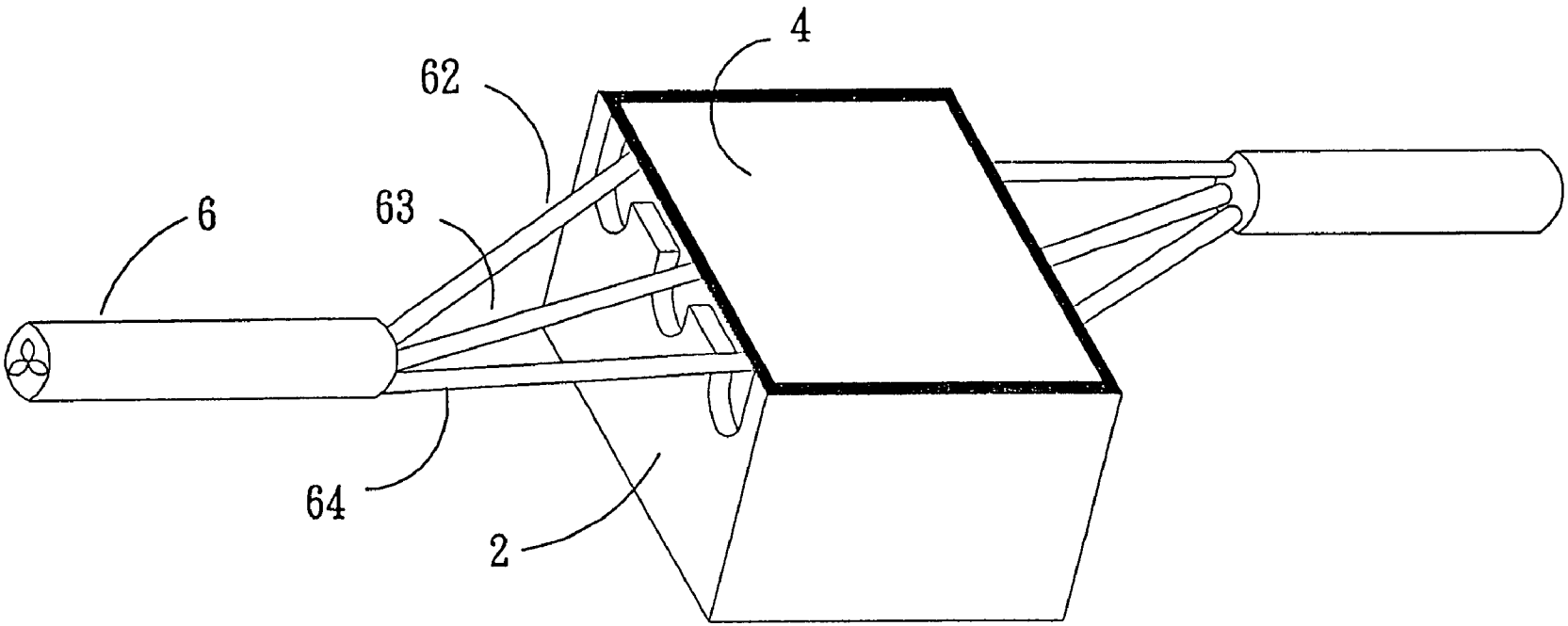
FIG. 5A is a three-dimensional view of the combination of a socket device according to the present invention.
Figure 5B:
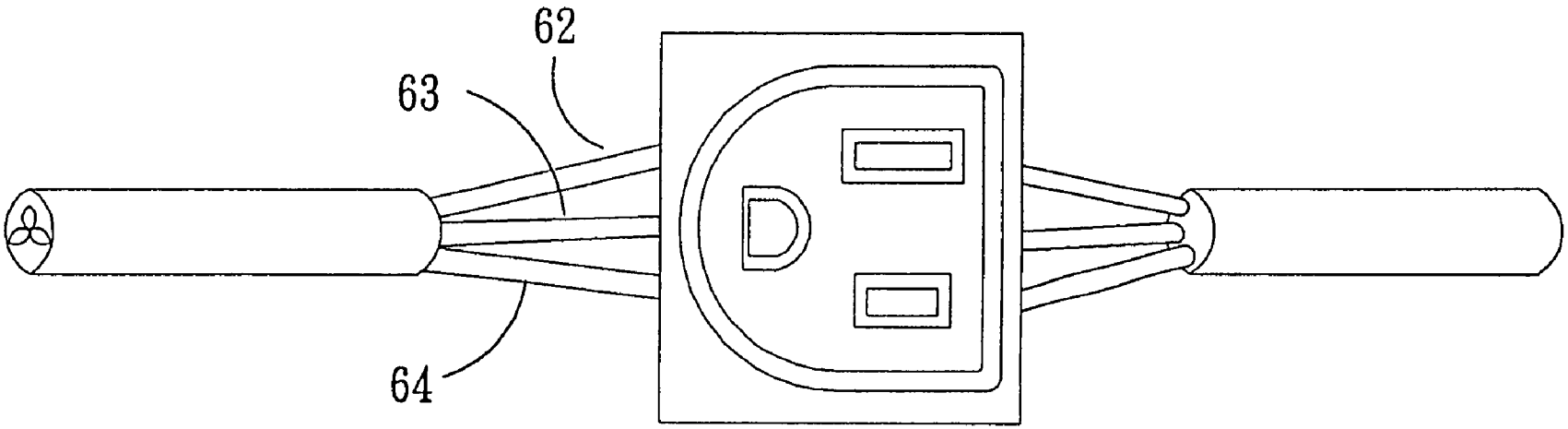
FIG. 5B is a front view of the combination of a socket device according to the present invention.
Figure 6C:
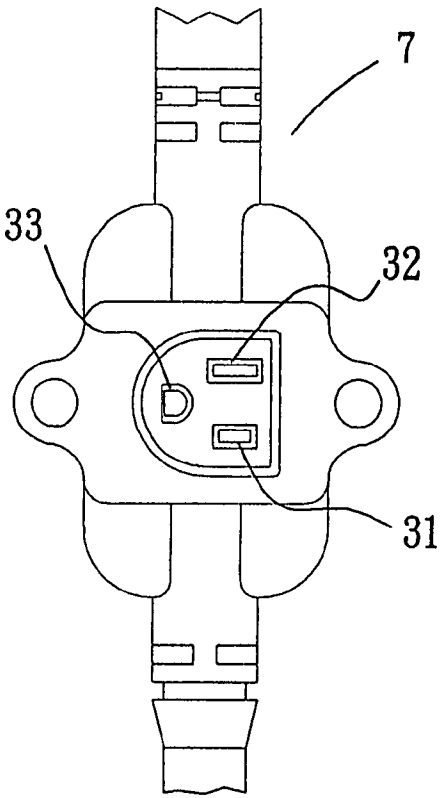
FIG. 6C is a bottom view of a cover shell according to the present invention.
Figure 6B:
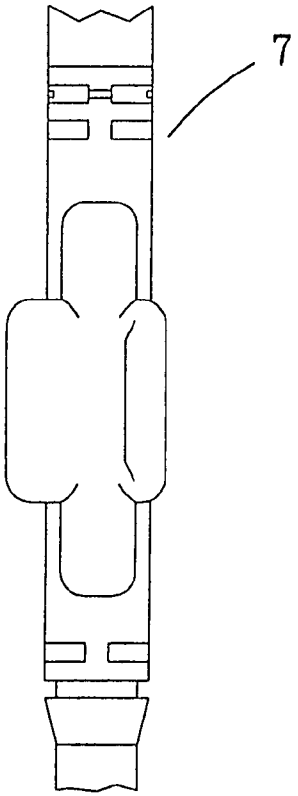
FIG. 6B is a cross-sectional view of a cover shell according to the present invention.
Figure 6A:
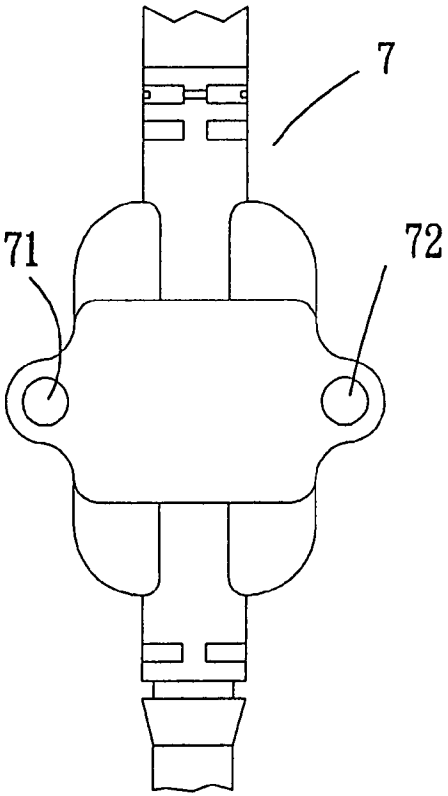
FIG. 6A is a top view of a cover shell according to the present invention.
Figure 7:
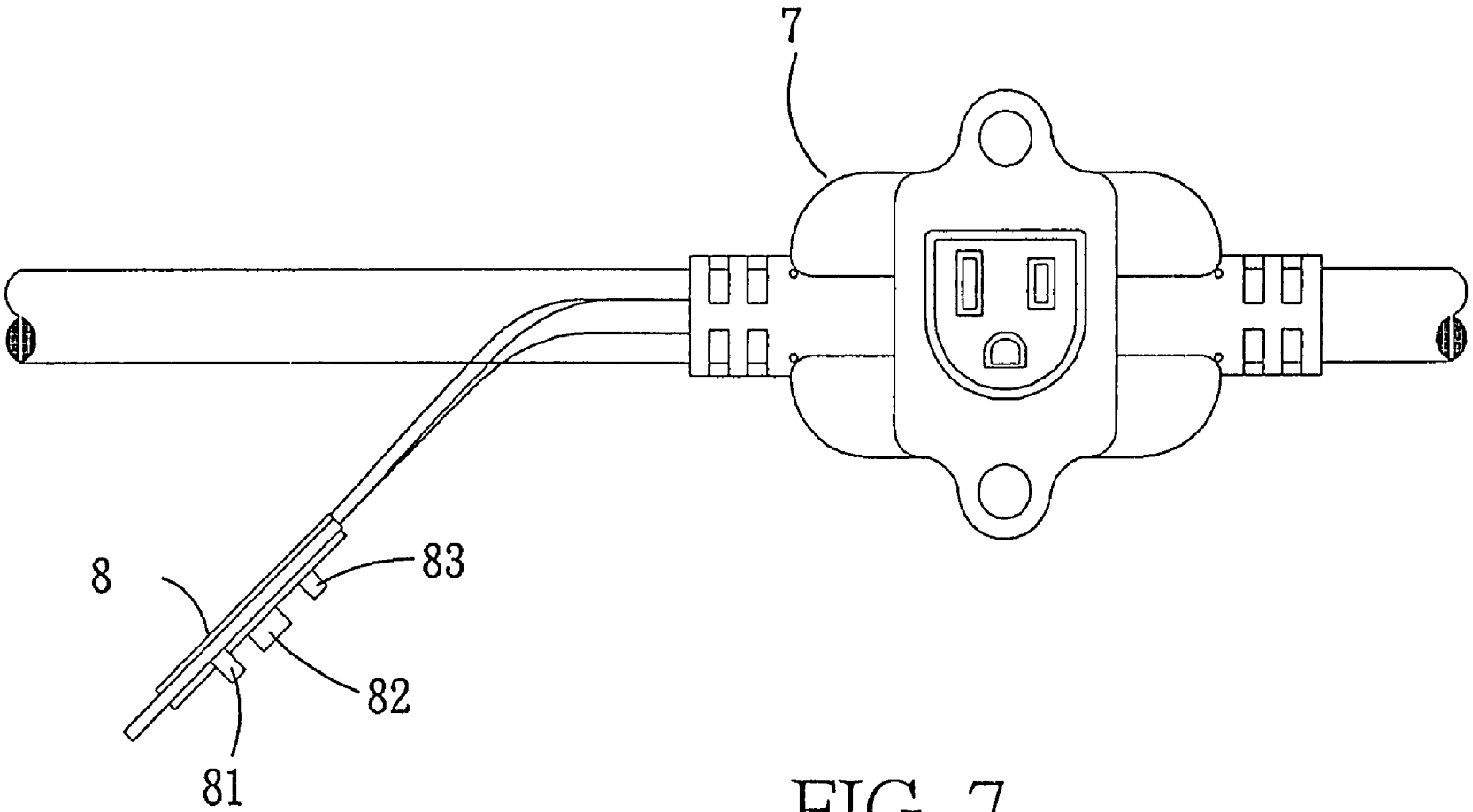
FIG. 7 is a graph showing a cover shell and safety cover according to the present invention.

According to FIG. 4, the power adaptive portion 69 includes three internal wires 62, 63, and 64 covered with PVC outer wire layer 6. The partial cover layer of each internal wire 62, 63, and 64 is peeled off to expose the bared wire 621, 631, and 641 and then used for crimping and connecting of the crimping end 371, 381, and 391 of the positive terminal 37, negative terminal 38, and grounding terminal 39 respectively. After the power adaptive portion 69 and terminal 37, 38, and 39 are crimped and combined, axial slot 34, 35, and 36 that are fit into the base 3 are then covered with a base cover 4, and thus the assembly of socket device 2 (as shown in FIGS. 5A and 5B) can be finished.

As shown in FIGS. 6A, 6B, 6C, and 7, the external part of the completely assembled socket 2 is provided with a the 7, capable of covering the socket device 2 and adjacent power adaptive region 69. The two side edges of the cover shell 7 have a fixed hole 71 and 72 respectively, wherein the end of the plug socket 31, 32, and 33 that corresponds to the socket is opened and makes the plug socket exposed. Then, in the safety cover 8, whose one end is connected to the cover shell, raised pillar 81, 82, and 83 are formed in the end of the safety cover 8 to plug the plug socket 31, 32, and 33 into the socket to completely protect the socket and prevent the dust from falling into the plug socket.

Figure 8:
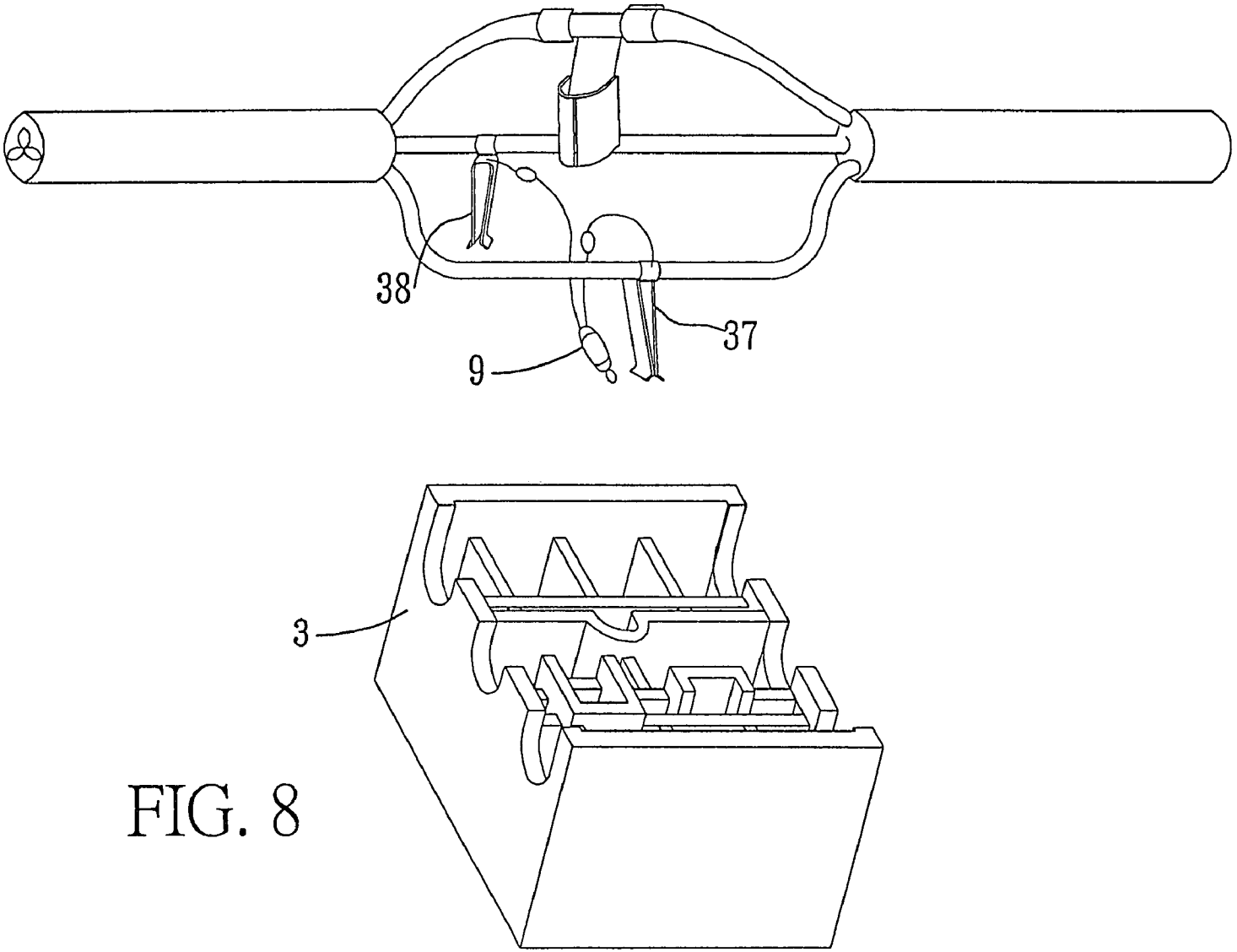
FIG. 8 is a three-dimensional view of the second embodiment according to the present invention.
Figure 9:
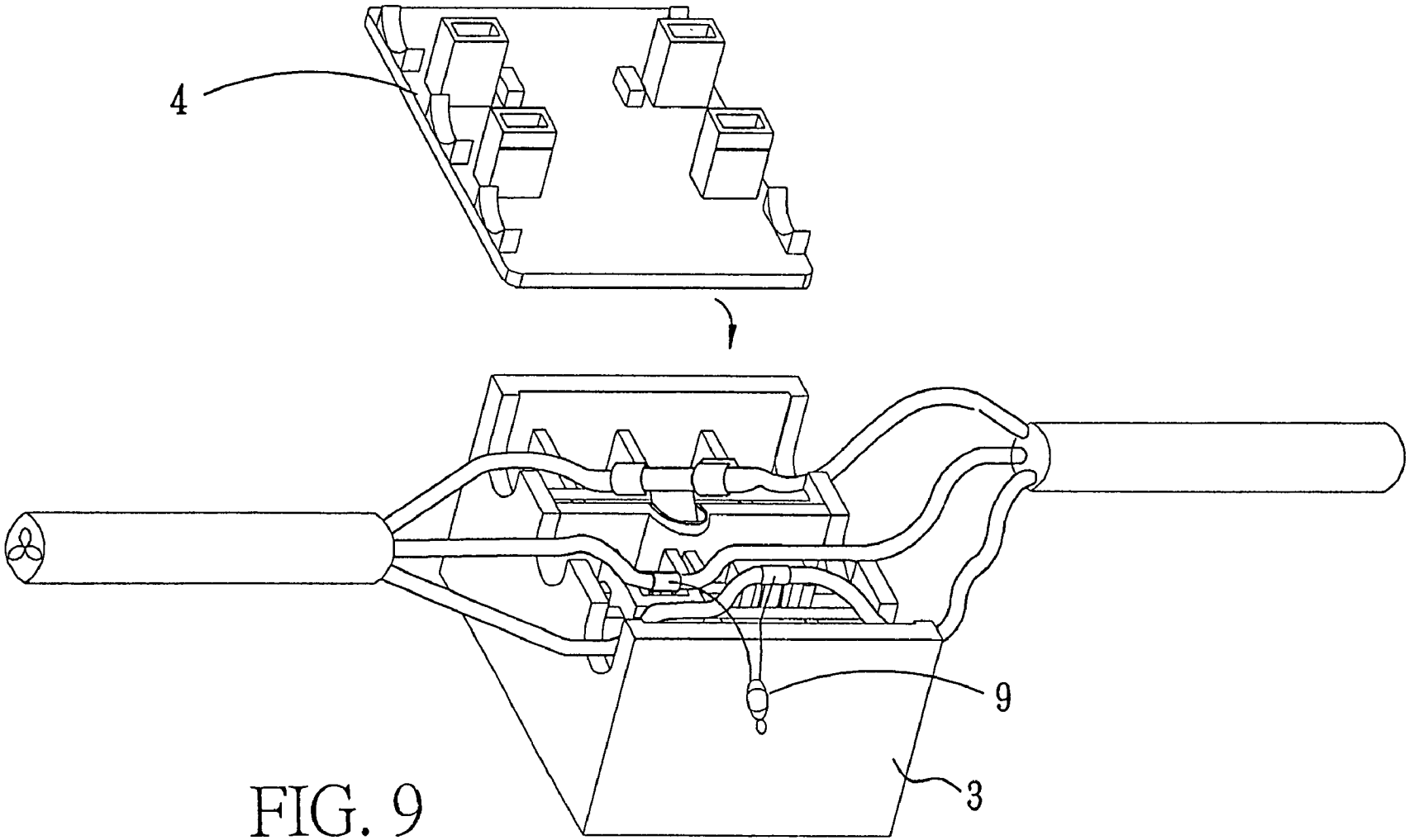
FIG. 9 is a three-dimensional disassembled view of the second embodiment according to the present invention.

As shown in FIGS. 8 and 9, neon lamp or an LED 9 can be put in the base 3, and the base 3 can be made as transparent materials in order to show the status of power conduction for the convenience of use in the night or in the wilderness.

According to the above description, the in-line socket of the present invention completely changes the conventional way of cutting off the power for connection, by directly peeling off the outer wire layer of the wire so that the wire can provide power transmission without loss of integrity. This not only solves the problem of unstable power transmission, but also avoids the time and cost of welding or reprocessing after being entwined. Moreover, through this invention, the terminal materials that account for the major cost can be largely reduced, and thus the material cost can also be relatively reduced. This makes possible easier maintenance, safer usage, more convenience, while enhancing the whole safety of the device through placing a cover shell in the external part of the socket and then operating in cooperation with the use of a safety cover.

The method for fabricating the in-line socket device comprises the steps of:

1. forming base 3 and base cover 4 through injection molding, wherein one end of the base 3 is opened, and the other end has three plug sockets 31, 32, and 33. The open ended side of the base 3 forms three through and mutually parallel axial slot 34, 35, and 36, adaptive space 361, 362, and 363 that are separated by a plurality of partitions to adapt conductor terminals, and scarf hole 51, 52, 53, 54, 55, and 56;

2. forming a positive terminal 37, a negative terminal 38, and a grounding terminal 39 through, making the crimping end 371 and 381 of the positive and negative terminal as upwardly raised arc-shaped conductor slice, its body being extended downward to form a terminal clip-head; the crimping end is formed in the upper edge of crimping end 391 of the grounding terminal, which is upwardly raised with double arc-shaped conductor slice provided within a proper distance, and its body serves as clip-head for clipping the plug grounding pillar;

3. peeling off the outer cover layer 6 and the outer layer of internal wires in advance, baring the wire 621, 631, and 641, crimping the positive terminal 37, negative terminal 38, and grounding terminal 39, and then placing them into the axial slots 34, 35, and 36 of the base;

4. Assembling the base cover 4 with pre-formed plug tenons 41, 42, 43, 44, 45, and 46 by the base cover. Among the plug tenons, plug tenons 41, 42, 43, and 44 are located in the left and right side respectively as rectangle frames, and can be plugged into the scarf holes 51, 52, 53, and 54 of the base. Moreover, there is provided the plug 45 and 46 within a proper distance near one side, which correspond to the scarf holes 55 and 56 of the base so that the two sides and upper edge of grounding terminal 39 are clipped to be fixed. Also, the partitioned partial arc-shaped raised pillars 47, 48, and 49 are provided in the corresponding position of its base side and the axial slot of base 34, 35, and 36, which can actualize the clipping upward and downward of the internal wires along with the base axial slots 34, 35, and 36 after its combination with the base 3 to ensure the stability of internal wires; and 5. forming a cover shell 7 and a safety cover 8 that is connected to the one end of the cover shell in the external part of the socket through injection molding, and forming raised pillars 81, 82, and 83 in the combination side of the safety cover 8 to promptly cover up the socket.

Through the in-line socket device as described above, the power adaptive region of the wires used for power transmission can be integrated as the whole without being cut off and re-connected, therefore, power transmission will not be affected by the material of connected conductor slice or other factors, that is, the power transmission efficiency can be maintained as the best condition and the problem of making the connecting parts falling off will not occur, which ensures the safety and usage of the device.

As described above, in the in-line socket device and its fabricating method of the present invention, since the wires in the socket are integrated as the whole, there is no necessity to cut off or entwine and connect to largely cut down the size of the terminals to reduce the material cost, and a cover shell and a base cover (etc.) are provided to keep the quality of power transmission stable and safe. Also, the present invention has not yet been made public, which is consistent with the relevant Patent Law.

Although the above-mentioned embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An in-line socket device comprising:

a base with an open side and a closed bottom side, a plurality of base plug sockets passed through said closed bottom side, and a plurality of adaptive spaces;

a base cover connected to said opened side of said base to form a closed socket;

a plurality of internal wires with an insulating layer, a power adaptive region of said internal wires, which are passed through said closed socket, an internal wire of said plurality of internal wires providing a terminal connection section at a designated connecting point of said base and said base cover, wherein said connection section of said internal wire is a bared wire portion that has been peeled off from said insulating layer;

a plurality of terminals, which correspond to the position of said base plug sockets and adapted in said adaptive spaces of said base, one end of said terminals connected to said bared wire portion at said connection section; and a cover shell, which covers said base, said base cover, and said peripheral power adaptive region;

wherein the connecting surface of the base cove and the open side of the base form a plurality of axial slots to allow internal wires to be fixed; the axial sot of the base is a partial arc-shaped slot; and the length of the bared wire portions are equal to the length of the socket grasping portions.

2. An in-line socket device as claimed in claim 1, wherein said internal wires are continuous at said terminal connection section.

3. An in-line socket device as claimed in claim 1, wherein said axial slot of said base is dis-continued.

4. An in-line socket device as claimed in claim 1, wherein a partial arc-shaped raised pillar is formed in the bottom side of said base cover that corresponds to said axial slot of said base, which can completely packet and clip said passed internal wire after being combined with said base.

5. An in-line socket device as claimed in claim 1, wherein a partial arc-shaped raised pillar is formed in the bottom side of said base cover that corresponds to said axial slot of said base, which can completely packet and clip said passed internal wire after being combined with said base.

6. An in-line socket device as claimed in claim 1, wherein said terminal is clipped by a clip head for clipping a plug conducting pillar.

7. An in-line socket device as claimed in claim 1, wherein said terminal is a clip tube with arched edge for clipping a plug grounding pillar.

8. An in-line socket device as claimed in claim 1, wherein said terminals include a positive terminal, a negative terminal, and a grounding terminal.

9. An in-line socket device as claimed in claim 1, wherein the one end of said cover shell is connected to a safety cover, which covers said plug socket so that a contamination by an unusual matter in said plug socket can be prevented.

10. An in-line socket device as claimed in claim 1, wherein the internal part of said base has neon lamps to indicate the status of power supply.

11. An in-line socket device as claimed in claim 1, wherein said base can be made from transparent materials.

12. An in-line socket device as claimed in claim 1, wherein the one end of said cover shell is transparent, making said plug socket of said socket exposed to a viewer.

13. An in-line socket device as claimed in claim 12, wherein one end of said safety cover that is relative to a plug socket forms a plurality of raised pillars to allow said plug socket plugged into said socket to be fixed.

14. An in-line socket device as claimed in claim 13, wherein said base can be made from transparent materials.

15. An in-line socket device as claimed in claim 1, wherein one end of said terminal is bent upward to connect to said bared wire.

16. An in-line socket device as claimed in claim 15, wherein said terminal is clipped by a clip head for clipping a plug conducting pillar.

17. An in-line socket device as claimed in claim 15, wherein said terminal is a clip tube with arched edge for clipping a plug grounding pillar.

18. An in-line socket device as claimed in claim 15, wherein said terminals include a positive terminal, a negative terminal, and a grounding terminal.

19. An in-line socket device as claimed in claim 18, wherein the one end of said cover shell is connected to a safety cover, which covers said plug socket so that a contamination by an unusual matter in said plug socket can be prevented.

20. An in-line socket device comprising:

a base with an open end and a closed bottom side, a plurality of plug sockets passing through said closed bottom side, and a plurality of adaptive spaces;

a base cover, which is connected to said open end of said base to form a closed socket;

a plurality of internal wires, which are passed through and provided in a connecting point of said base and said base cover wherein at least one section in said internal wire is a bared wire that has been peeled off from an insulating layer; and a plurality of terminals, corresponding to the position of said base plug socket and adopted in said adaptive space of said base, and its one end is connected to said bared wire;

wherein the connecting surface of the base cove and the open side of the base form a plurality of axial slots to allow internal wires to be fixed; the axial sot of the base is a partial arc-shaped slot; and the length of the bared wire portions are equal to the length of the socket grasping portions.

21. An in-line socket device as claimed in claim 20, wherein said wire is continuous.

22. An in-line socket device as claimed in claim 20, wherein said axial slot of said base is discontinued.

23. An in-line socket device as claimed in claim 20, wherein a partial arc raised pillar is formed in the bottom side of said base cover that corresponds to said axial slot of said base, which can completely packet and clip said passed internal wires after being combined with said base.

24. An in-line socket device as claimed in claim 20, wherein said terminal is a terminal clip head for clipping a plug conducting pillar.

25. An in-line socket device as claimed in claim 20, wherein said terminal is a clip tube with arched edge for clipping a plug grounding pillar.

26. An in-line socket device as claimed in claim 20, wherein said terminals include a positive terminal, a negative terminal, and a grounding terminal.

27. An in-line socket device as claimed in claim 20, wherein the internal part of said base has lamps to indicate the status of power supply.

28. An in-line socket device as claimed in claim 20, wherein said base can be made from transparent materials.

29. An in-line socket device as claimed in claim 20, wherein one end of said terminal is extended and bent upward to be connected to said bared wire.

30. An in-line socket device as claimed in claim 29, wherein said terminal is a terminal clip head for clipping a plug conducting pillar.

31. An in-line socket device as claimed in claim 28, wherein said terminal is a clip tube with arched edge for clipping a plug grounding pillar.

32. An in-line socket device as claimed in claim 29, wherein said terminals include a positive terminal, a negative terminal, and a grounding terminal.

33. A method for fabricating an in-line socket device, the method comprising the steps of:

forming a base and a base cover through injection molding, making one end of said base as open and the other end as closed, which has a plurality of plug sockets, in which a plurality of through a set of axial slots and a set of adaptive spaces that can accommodate a plurality of conductor terminals are formed;

forming said conductor terminals through stamping, making the end of said conductor terminals extend toward one end;

covering said wires that have been peeled off of an outer layer PVC and an internal layer PVC to said axial slot of said base, and connecting the bared said wires to said terminals;

assembling said base cover with said base; and forming a cover shell and a safety cover that is connected with one end of said cover shell in the external part of said socket through injection molding;

wherein the connecting surface of the base cove and the open side of the base form a plurality of axial slots to allow internal wires to be fixed; the axial sot of the base is a partial arc-shaped slot; and the length of the bared wire portions are equal to the length of the socket grasping portions.

* * * * *